US007481559B1

(12) United States Patent
Rashidi

(10) Patent No.: US 7,481,559 B1
(45) Date of Patent: Jan. 27, 2009

(54) APPARATUS TO RAPIDLY INSERT A SOCKET ASSEMBLY INTO A CEILING FIXTURE

(76) Inventor: Hamid Rashidi, 139 N. Clark Dr., Beverly Hills, CA (US) 90211

( * ) Notice: Subject to any disclaimer, the term of this patent is extended or adjusted under 35 U.S.C. 154(b) by 0 days.

(21) Appl. No.: 11/656,284

(22) Filed: Jan. 22, 2007

(51) Int. Cl.
*F21V 15/00* (2006.01)
*F21V 17/00* (2006.01)

(52) U.S. Cl. ..... 362/365; 362/147; 362/364; 362/396

(58) Field of Classification Search ..... 362/147, 362/364, 365, 396
See application file for complete search history.

(56) References Cited

U.S. PATENT DOCUMENTS 6,089,732 A * 7/2000 Wright et al. ..... 362/364
6,247,832 B1 * 6/2001 Neustadt ..... 362/356

* cited by examiner

*Primary Examiner*—Sandra O'Shea
*Assistant Examiner*—James W Cranson
(74) *Attorney, Agent, or Firm*—Thomas I. Rozsa

(57) ABSTRACT

The present invention is an improved apparatus to very rapidly install a lightbulb socket assembly within the housing of a recessed lighting fixture. Through the present invention, the lightbulb socket assembly is removed from the housing fixture during shipment so that it will not be damaged and when the fixture is ready to be installed, the present invention permits the socket assembly to be very rapidly installed and affixed to the base plate of the lightbulb housing.

6 Claims, 3 Drawing Sheets

APPARATUS TO RAPIDLY INSERT A SOCKET ASSEMBLY INTO A CEILING FIXTURE

BACKGROUND OF THE INVENTION

1. Field of the Invention

The present invention relates to the field of lighting fixtures and more particularly to socket assemblies which are retained within a recessed ceiling fixture.

2. Description of the Prior Art

In general, ceiling fixtures come with pre-attached and prewired lightbulb sockets. However, during shipment, it is easy for the sockets to be damaged. Therefore, there is a significant need for an improved method and apparatus to separately ship a socket assembly and rapidly connect the socket assembly to the recessed ceiling fixture when the fixture is being installed.

SUMMARY OF THE INVENTION

The present invention is an improved apparatus to very rapidly install a lightbulb socket assembly within the housing of a recessed lighting fixture. Through the present invention, the lightbulb socket assembly is removed from the housing fixture during shipment so that it will not be damaged and when the fixture is ready to be installed, the present invention permits the socket assembly to be very rapidly installed and affixed to the base plate of the lightbulb housing.

It has been discovered, according to the present invention, that if the lightbulb socket assembly includes a pair of oppositely disposed hook connecting members and the base plate has affixed thereon a pair of spaced apart mounting screws, then the socket assembly can be rapidly affixed to the base plate by a twisting motion of inserting the socket assembly adjacent the mounting screws and rotating the hook connecting members onto the mounting screws. Thereafter, the mounting screws are tightened and the socket assembly is rapidly affixed to the base plate of the ceiling fixture housing.

While the preferred embodiment is to have a pair of mounting screws and a pair of hook attaching members on the socket assembly, it is also within the spirit and scope of the present invention to have at least one mounting screw and at least one hook connecting member on the socket assembly to affix the socket assembly onto the base plate of the lighting fixture.

It is therefore an object of the present invention to provide a lightbulb socket assembly which includes a pair of oppositely disposed hook connecting members and also having the base plate including a pair of spaced apart mounting screws affixed thereon so that the socket assembly can be rapidly affixed to the base plate by a twisting motion of inserting the socket assembly adjacent the mounting screws and rotating the hook connecting members onto the mounting screws. Thereafter, the mounting screws are tightened and the socket assembly is rapidly affixed to the base plate of the ceiling fixture housing.

It is also an object of the present invention to have at least one mounting screw and at least one hook connecting member on the socket assembly to affix the socket assembly onto the base plate of the lighting fixture.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
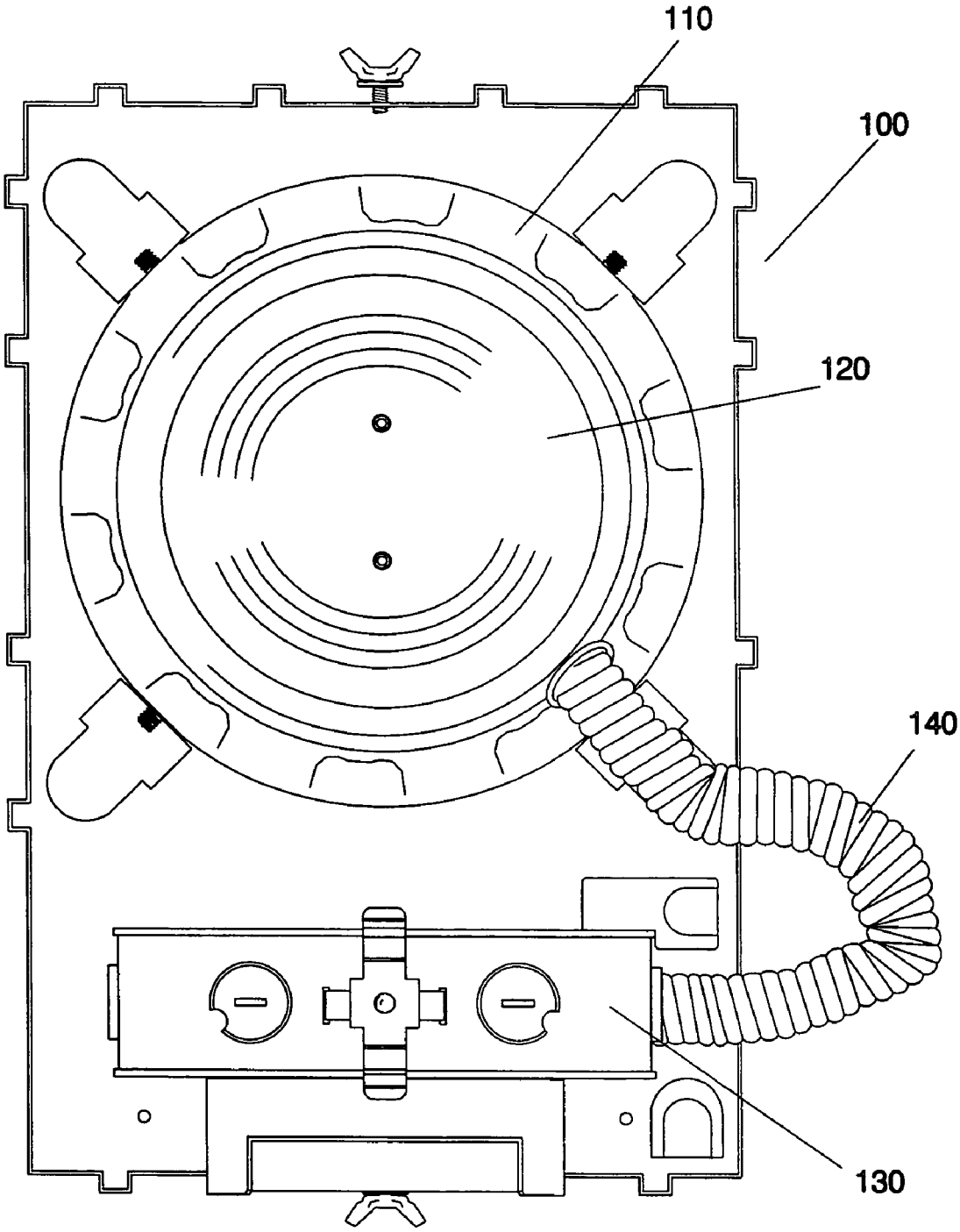
FIG. 1 is a bottom plan view of a housing for a recessed lighting ceiling fixture showing the mounting screws in the base of the ceiling fixture which mounting screws are used to retain the present invention quick connect socket.

Referring to FIG. 1, there is illustrated a bottom plan view of a conventional housing 100 for a recessed lighting ceiling fixture which does not contain a prefixed socket assembly for a lightbulb. In the prior art, the housing already contains the socket assembly. However, during shipping, it is easy for the socket assembly to be damaged. Therefore, the present invention addresses this problem by removing the lightbulb socket assembly from the housing before shipment and then providing a quick connect system to rapidly wire and affix the socket assembly into the ceiling fixture 100.

The housing contains a metal housing member 110 which has a horizontal base plate 120 as viewed form the bottom. The socket assembly is conventionally affixed to the upper interior side o the base plate. The assembly can also include a junction wiring box 130 which contains conventional electronic components such as a transformer and means to hard wire the assembly to the wiring of the residence or industrial or office building. A metal cable housing 140 connects the wires from the junction wiring box 130 to the housing 110 so that the wires from the wiring box can be connected to wires from the socket assembly.

Figure 2:
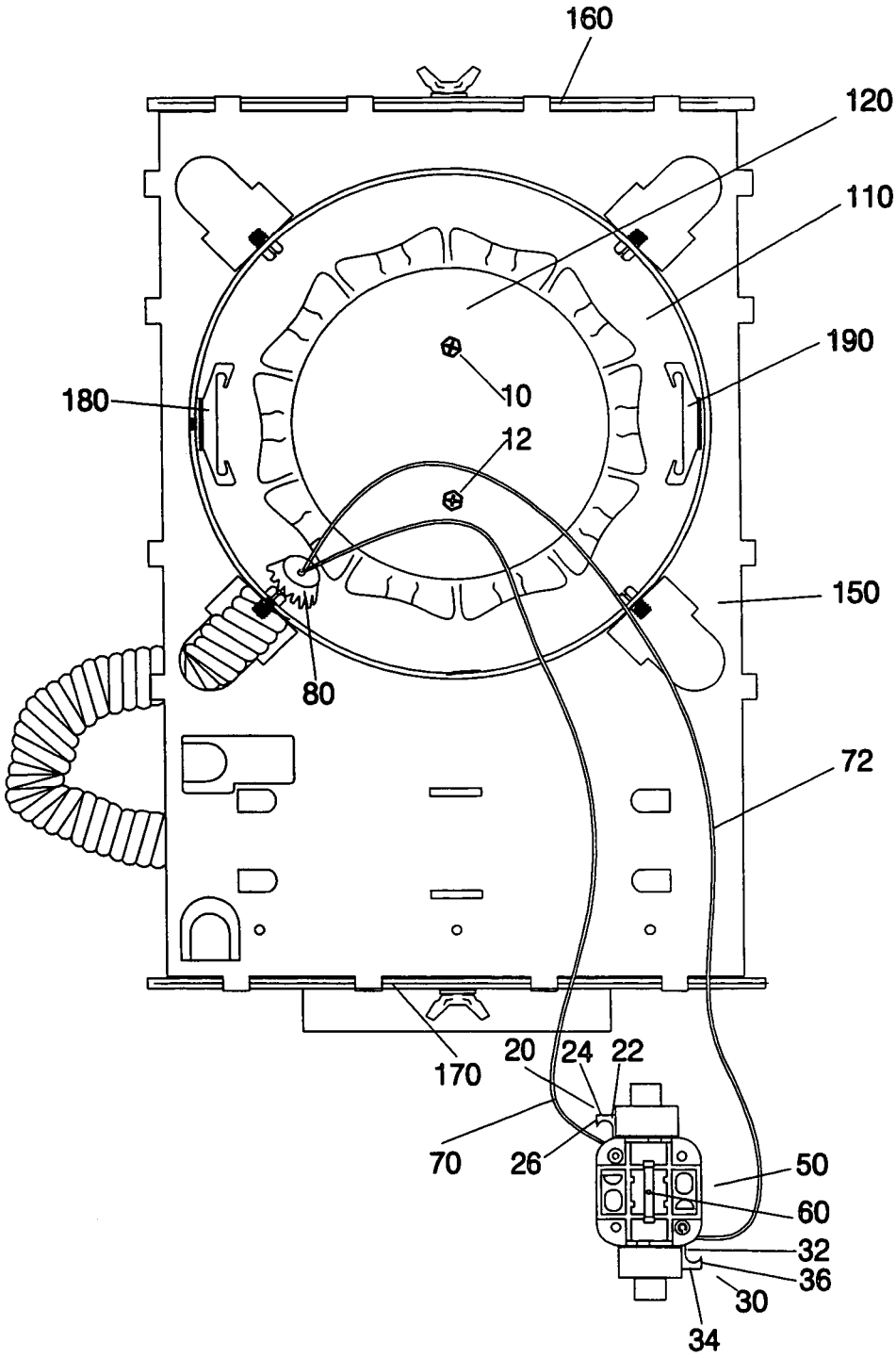
FIG. 2 is a is a top plan view of a housing for a recessed lighting ceiling fixture with the present invention quick connect socket wired into the fixture and not yet in place on the mounting screws.

Referring to the top plan view of FIG. 2 showing the interior of the housing member 110, the housing member 110 is affixed to a metal plate 150 which in turn is connected to bar hangers 160 and 170 by which the ceiling fixture is mounted between beams in the ceiling where the recessed lighting fixture is to be mounted. The interior wall of the lighting 110 also contains a pair of oppositely disposed retaining clip members 180 and 190 by which a reflector is mounted within the housing 110. In the center of the housing 110 is the base plate 120. A socket assembly for retaining a lightbulb is conventionally affixed to the base plate 120. However, the improvement of the present invention is to have the socket assembly removed so that it will not be damaged during shipment.

Figure 3:
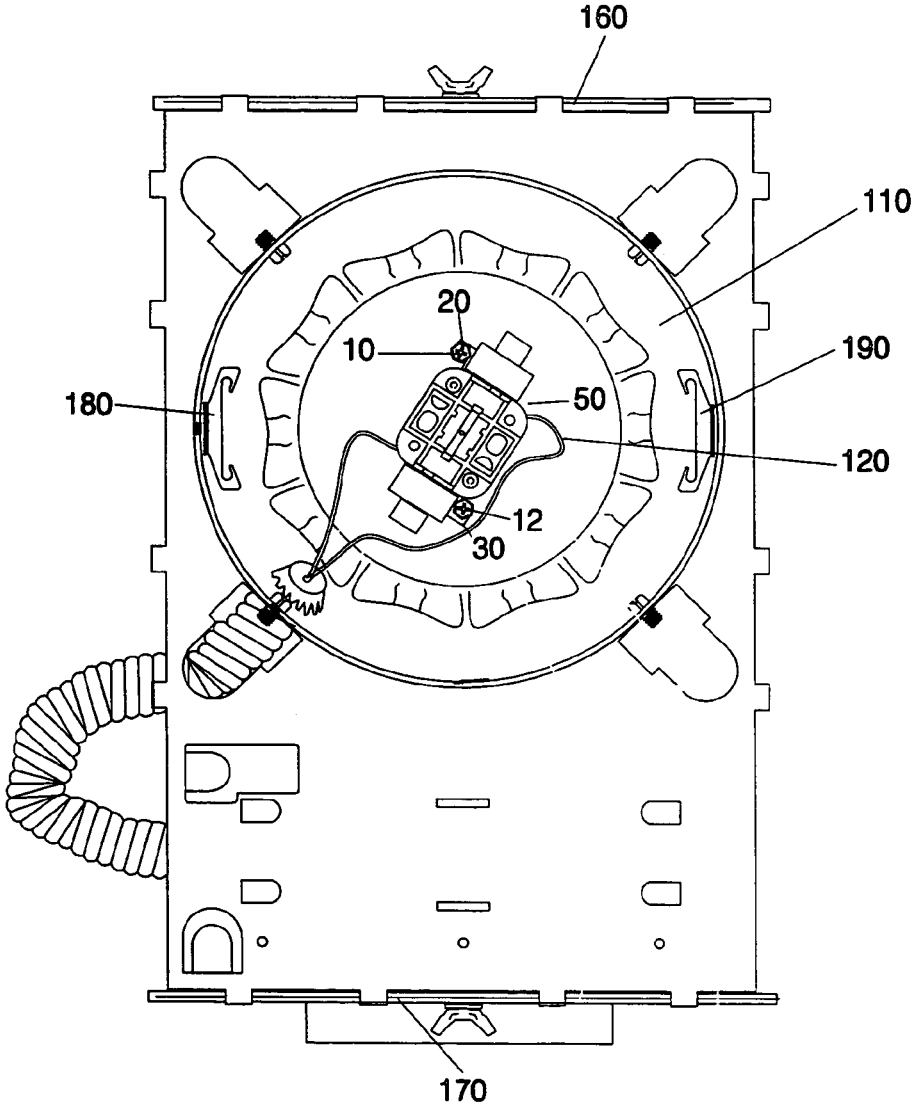
FIG. 3 is a top plan view of a housing for a recessed lighting ceiling fixture with the present invention quick connect socket assembly in place and retained by the mounting screws.

The improvement of the present invention is to affixed a pair of spaced apart mounting screws 10 and 12 into the base plate 120. The socket assembly 50 contains a central socket member 60 into which a lightbulb is affixed and a pair of wires 70 and 72 which are wired into a connector 80 in the wall of the housing 110 so that the wires 70 and 72 are connected to wires form the junction wiring box 130. The significant improvement of the present invention is the addition of a pair of oppositely disposed hook or connecting members 20 and 30 located at opposite corners of the socket assembly 50. Connecting member 20 has a longitudinal arm 22, a transverse portion 24 and a hook portion 26. Similarly, connecting member 30 has a longitudinal arm 32, a transverse portion 34 and a hook portion 36. The socket assembly 50 is placed into the housing 110 and rests on the base plate 120 so that first connecting member 20 is just to the right of mounting screw 10 and second connector member 30 is just to the left of mounting screw 12. Then with a counterclockwise rotational motion, the connecting members are inserted onto their respective mounting screws so that the hook portion 26 and 36 respectively surround the respective mounting screws 10 and 12. This is illustrated in the top plan view of FIG. 3. The mounting screws are then tightened so that the socket assembly is firmly affixed onto the base 120 of the housing 110. The socket is then ready for use.

Therefore, through the present invention, the socket assembly 50 is removed from the housing assembly so that it will not be damaged during shipment and then when it is ready for installation, the socket assembly 50 can be very quickly and efficiently installed inside of the housing assembly 110 and is ready for use. The reflector is then affixed to the clip members 180 and 190 and surrounds the socket assembly 50 and a lightbulb is then inserted into the socket 60 of the socket assembly 50.

Therefore, through the present invention, the socket assembly 50 will not be damaged during shipment and can be very quickly and efficiently installed for use when the ceiling fixture is mounted into a ceiling of a structure.

While the preferred embodiment of the present invention is to have a pair of oppositely disposed hook connecting members 20 and 30 connected to a pair of spaced apart mounting screws 10 and 12, it is also within the spirit and scope of the present invention to have at least one hook connecting member 20 or 30 connected to at least one mounting screw 10 or 12.

Defined in detail, the present invention is a housing for a ceiling fixture including a base plate, the improvement comprising: (a) a first mounting screw affixed to said base plate and a second mounting screw affixed to said base plate, the mounting screws being spaced apart by a given distance; (b) a socket assembly including a lightbulb socket and a pair of oppositely disposed hook connecting members including a first hook connecting member having a longitudinal arm, a transverse portion and a hook portion, the second hook connecting member having a longitudinal arm, a transverse portion and a hook portion; and (c) the socket assembly connected to the ceiling fixture by having the first hook connecting member mounted on said first mounting screw and the second hook connecting member mounted on the second mounting screw by positioning the socket assembly on the base plate and rotating the connecting members onto a respective mounting screw, the mounting screws being tightened into the base plate after the hook members are respectively mounted on a mounting screw.

Defined more broadly, the present invention is a housing for a ceiling fixture including a base plate, the improvement comprising: (a) a first mounting screw affixed to said base plate and a second mounting screw affixed to said base plate, the mounting screws being spaced apart by a given distance; (b) a socket assembly including a lightbulb socket and a pair of spaced apart hook connecting members respectively aligned with a respective mounting screw; and (c) the socket assembly connected to the ceiling fixture by having one aligned hook connecting member mounted on said first mounting screw and the other aligned hook connecting member mounted on the second mounting screw by positioning the socket assembly on the base plate and rotating the connecting members onto a respective mounting screw, the mounting screws being tightened into the base plate after the hook connecting members are respectively mounted on a mounting screw.

Defined most broadly, the present invention is a housing for a ceiling fixture including a base plate, the improvement comprising: (a) at least one mounting screw affixed to said base; (b) a socket assembly including a lightbulb socket and at least one hook connecting member; and (c) the socket assembly connected to the ceiling fixture by having the at least one hook connecting member mounted on said first mounting screw by positioning the socket assembly on the base plate and rotating the at least one hook connecting member onto the at least one mounting screw, the at least one mounting screw being tightened into the base plate after the at least one hook connecting member is mounted on the at least one mounting screw.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A housing for a ceiling fixture including a base plate, an improvement comprising:

a. a first mounting screw affixed to said base plate and a second mounting screw affixed to said base plate, the mounting screws being spaced apart by a given distance;

b. a socket assembly including a lightbulb socket and a pair of oppositely disposed hook connecting members including a first hook connecting member having a longitudinal arm, a transverse portion and a hook portion, the second hook connecting member having a longitudinal arm, a transverse portion and a hook portion; and c. the socket assembly connected to the ceiling fixture by having the first hook connecting member mounted on said first mounting screw and the second hook connecting member mounted on the second mounting screw by positioning the socket assembly on the base plate and rotating the connecting members onto a respective mounting screw, the mounting screws being tightened into the base plate after the hook members are respectively mounted on a mounting screw.

2. The housing for a ceiling fixture in accordance with claim 1 wherein the socket assembly further comprises wires which are hard wired into wires from a junction wiring box.

3. A housing for a ceiling fixture including a base plate, an improvement comprising:

a. a first mounting screw affixed to said base plate and a second mounting screw affixed to said base plate, the mounting screws being spaced apart by a given distance;

b. a socket assembly including a lightbulb socket and a pair of spaced apart hook connecting members respectively aligned with a respective mounting screw; and c. the socket assembly connected to the ceiling fixture by having one aligned hook connecting member mounted on said first mounting screw and the other aligned hook connecting member mounted on the second mounting screw by positioning the socket assembly on the base plate and rotating the connecting members onto a respective mounting screw, the mounting screws being tightened into the base plate after the hook members are respectively mounted on a mounting screw.

4. The housing for a ceiling fixture in accordance with claim 3 wherein the socket assembly further comprises wires which are hard wired into wires from a junction wiring box.

5. A housing for a ceiling fixture including a base plate, an improvement comprising:

a. at least one mounting screw affixed to said base;

b. a socket assembly including a lightbulb socket and at least one hook connecting member; and c. the socket assembly connected to the ceiling fixture by having the at least one hook connecting member mounted on said first mounting screw by positioning the socket assembly on the base plate and rotating the at least one hook connecting member onto the at least one mounting screw, the at least one mounting screw being tightened into the base plate after the at least one hook connecting member is mounted on the at least one mounting screw.

6. The housing for a ceiling fixture in accordance with claim 5 wherein the socket assembly further comprises wires which are hard wired into wires from a junction wiring box.

* * * * *